US005471235A

United States Patent [19]

Patry

[11] Patent Number: 5,471,235

[45] Date of Patent: Nov. 28, 1995

[54] DEVICE FOR READING THE PRINTING DONE BY A TRANSFER THERMAL PRINTER

[75] Inventor: Bernard Patry, Orsay, France

[73] Assignee: Axiohm, Montrouge, France

[21] Appl. No.: 346,290

[22] Filed: Nov. 23, 1994

[30] Foreign Application Priority Data

Nov. 24, 1993 [FR] France ..... 93 14070

[51] Int. Cl.[6] ..... B41J 32/00

[52] U.S. Cl. ..... 347/214; 400/207; 400/208; 400/208.1

[58] Field of Search ..... 400/207, 207 E, 400/208.1, 208; 346/76 PH, 76 L; 347/214

[56] References Cited

U.S. PATENT DOCUMENTS

| | | | |
|---|---|---|---|
| 4,603,337 | 7/1986 | Erlichman | 346/76 PH |
| 4,857,942 | 8/1989 | Murphy et al. | 346/76 PH |
| 4,901,090 | 2/1990 | Ozawa et al. | 346/76 PH |
| 4,917,515 | 4/1990 | Piller et al. | 400/208 |
| 5,325,115 | 6/1994 | Tanahashi | 346/76 PH |
| 5,354,134 | 10/1994 | Patry | 400/208 |

FOREIGN PATENT DOCUMENTS 3800113 7/1988 Germany .

OTHER PUBLICATIONS

IBM Technical Disclosure Bulletin, vol. 16 No. 7 Décembre 1973, New York US p. 2189.

*Primary Examiner*—Huan H. Tran

*Attorney, Agent, or Firm*—Griffin, Butler, Whisenhunt & Kurtossy

[57] ABSTRACT

A recording device for recording impressions made by a transfer thermal printer, the device comprising a transfer film paid out from a roll and taken up by a drum, the roll and the drum being disposed inside a cassette having a side wall including a setback defining a print zone, wherein the cassette includes a read window other than the print zone, guides designed to impose a path on the transfer film such that the transfer film passes the window between the roll and the drum, and a support for a contrast surface.

5 Claims, 1 Drawing Sheet

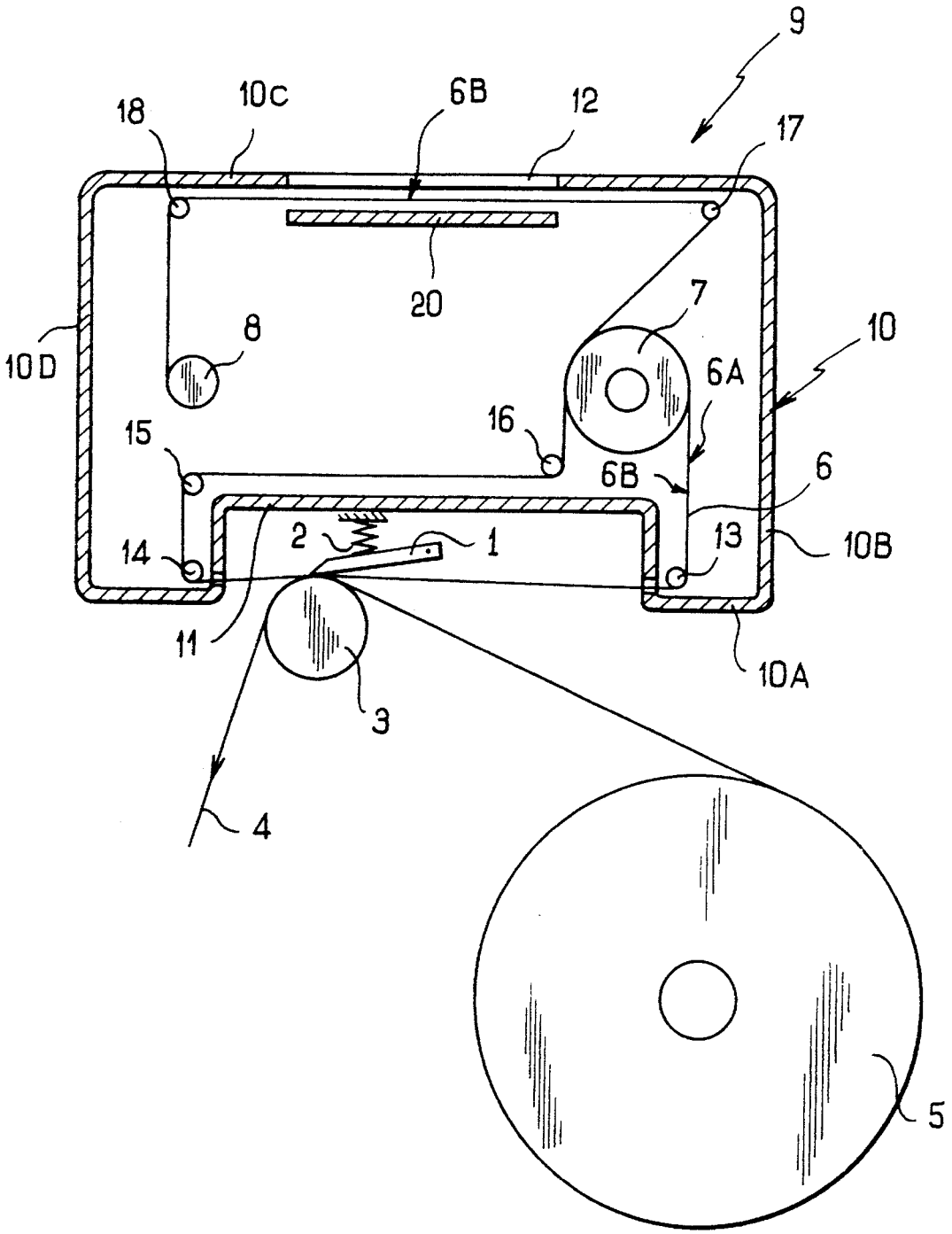
9
18
10C
6B
12
17
20
7
10
10D
8
6A
16
15
6B
6
2
1
13
10B
14
11
10A
3
4
5

DEVICE FOR READING THE PRINTING DONE BY A TRANSFER THERMAL PRINTER

BACKGROUND OF THE INVENTION

It is common practice in the field of cash registers to record the printing done by a transfer thermal print head. The film supporting the transferred ink leaves a transparent zone from where the ink has disappeared. This means that a negative record is available of the printing that has been done. In existing recording devices, the ink-carrying film travels between two wheels: a take-up wheel and a pay-out wheel; the two wheels being contained in a cassette-forming housing. The cassette makes it possible to install the film in the printer and to remove it therefrom, and above all the cassette can be reused when reading the film medium. It thus constitutes a log of the operations performed by the printer.

Nevertheless, reading is generally performed in the same zone of the cassette as that where the film co-operates with the print head, thus restricting the scope of such reading and sometimes requiring a special apparatus to be used.

OBJECTS AND SUMMARY OF THE INVENTION

The invention seeks to propose a device providing easy and direct access to the information carried on the film medium.

To this end, the invention provides a recording device for recording the printing done by a transfer thermal printer, the device comprising a transfer film paid out from a roll and taken up by a drum, the film having a face for contacting the print head of the thermal printer, the roll and the drum being disposed inside a cassette having a side wall including a setback defining a print zone, wherein the cassette includes a read window other than the print zone, and guides designed to impose a path on the transfer film such that the transfer film travels from the print zone to the window between the roll and the drum.

Thus, the path imposed on the transfer film enables the information carried by the transfer film to appear in a manner that is directly usable from in front of the read window specially provided for that purpose.

According to an advantageous feature of the invention, the cassette includes a support for a contrast surface that is visible through the read window, the path of the transfer film being situated between the window and the support.

Thus, the information that is available in negative on the transfer film can be recovered clearly.

According to another advantageous feature of the invention, the guides impose a path on the transfer film such that in the portion of the path of the transfer film situated between the roll and the drum, the transfer film comes into contact with a cylindrical portion of the roll.

This contact has the advantage of ensuring constant linear speed of the film on either side of the printer and makes it possible to obtain a better distribution of tension stresses in the film, thus reducing risks of breakage.

According to a third advantageous feature of the invention, the read window is provided in a side wall of the cassette that is opposite to the side wall defining the print zone, and the guides include at least two deflection cylinders between which the transfer film passes between the roll and the drum.

In this way, the path imposed on the transfer film is Z-shaped and the film is thus the right way round for reading when visible through the read window which is provided on the side of the cassette opposite to its recording window, and which is therefore easily accessible.

According to a fourth advantageous feature of the invention, the said at least two deflection cylinders are situated in the vicinity of a common diameter of the roll.

In this way, contact between the transfer film and the roll is ensured regardless of the diameter of the roll, which diameter varies as the film is reeled on or off the roll.

BRIEF DESCRIPTION OF THE DRAWING

Other features and advantages appear from the following description of an embodiment of the invention given by way of example.

Reference is made to the accompanying drawing in which the sole figure is a view of a transfer film cassette of the invention.

MORE DETAILED DESCRIPTION

The figure is a fragmentary section view showing the essential mechanical elements of a thermal printer. Thus, the printer comprises a print head 1 in the form of a strip carrying a line of heating points in conventional manner, the print head being pressed by a resilient member 2 against a roll 3 known as a capstan. Between the print head 1 and the capstan 3 there pass both paper to be printed 4 coming from a roll 5, and a transfer film 6 whose inked face 6A is in contact with the paper to be printed 4 and whose opposite face 6B faces the print head 1. The film comes from a roll 7 and is collected on a drum 8. The transfer film 6 acts as a support for a meltable ink deposited on its inked face 6A such that under the effect of heat delivered by each point against its opposite face 6B, the ink carried by the face 6A which is in contact with the paper 4 is transferred to the paper where it adheres, thus becoming detached from the transfer film 6.

It is recalled that the paper is driven by friction against the capstan 3 and that the print head 1 is made up of two portions that move relative to each other between a position in which the members co-operate with one another as shown in the figure and another position in which the print head is remote from the capstan so as to make it possible to install and remove the paper medium 4 and the transfer film 6 which are the consumables of the apparatus.

The transfer film 6 is contained in a cassette 9. In conventional manner the cassette comprises a generally rectangular housing 10 made up of two interfitting portions provided with two pairs of facing studs to form bearings for the roll 7 and for the drum 8. The roll and the drum are thus mounted to rotate inside the housing 10 about two parallel axes. The housing 10 is defined by side walls 10A, 10B, 10C, and 10D. A setback 11 in the wall 10A defines a zone in which the transfer film 6 lies outside the housing and co-operates with the printer 1, 3 and with the paper 4.

In addition, in accordance with the invention, the cassette 9 includes a read window 12 that is preferably formed in the side wall 10C of the housing 10 that is opposite to the setback 11. The cassette 9 also includes guides 13, 14, 15, 16, 17, and 18 constituted by deflection cylinders mounted to rotate inside the housing 10 about six pairs facing studs, the deflection cylinders being designed to impose a path on the transfer film 6 such that its face 6B that comes into contact with the print head 1 also faces the read window 12. This result is achieved by the fact that the transfer film 6 passes between the roll 7 and the drum 8 as it travels from the print zone and the window. The path imposed on the transfer film 6 is thus Z-shaped, and as a result the information carried by the transfer film 6 passes behind the read window 12 in a manner that makes it directly readable and usable. The deflection cylinders 16 and 17 are preferably both situated close to a common diameter of the roll, so as to ensure that the portion of the path of the transfer film 6 that is situated between the roll and the drum comes into contact with a cylindrical portion of the roll 7. It is possible to place a support 20 for a contrasting surface, e.g. a white surface inside the cassette 9 so as to be visible through the read window 12, this surface is thus visible through the transfer film 6 in the zones thereof that have no ink, thus making said zones all the more readable, the film passing between the support 20 and the window 12.

The cassette 9 is used initially for printing where it serves to provide the printer with unused transfer film 6 that is paid out from the roll 7 and that is taken up by the drum 8. The portion of the transfer film 6 in the setback 11 is placed in the print head 1.

Once it has been fully used, the cassette 9 is removed from the printer and the roll 7 can be reconstituted by re-winding. The transfer film 6 can then be examined through the read window 12 by causing it to wind forward, with examination consisting in reading the negative of the printing as visible on the film, either merely by visual inspection, or else by passing through an optical reader. The transfer film 6 may also be used, without prior re-winding, by causing the information it carries to run through in the reverse of the printing direction. In a third method of use, the information carried by the transfer film is read simultaneously with printing, without any need to extract the cassette from the printer, given the situation of the window 12 in a lateral zone that is different from, and preferably opposite to, the print zone 11.

The contact established by the guides 16 and 17 between the transfer film 6 and the roll 7 serves to guarantee, by adhesion, that the transfer film travels at the same speed both upstream and downstream from the print head 1.

In a variant of the invention (not shown), the read window 12 may be provided on a different side face of the housing 1, other than the face containing the print zone 11.

I claim:

1. In a device for reading impressions made by a transfer thermal printer having a print head, wherein the device has a transfer film paid out from a roll and taken up by a drum, the transfer film having a face for contacting the print head of the transfer thermal printer, the roll and the drum being disposed inside a cassette having a side wall including a setback defining a print zone, the improvement wherein the cassette has a read window other than the print zone, and guides for imposing a path on the transfer film such that the transfer film travels from the print zone to the read window between the roll and the drum.

2. A reading device according to claim 1, wherein the cassette includes a support for a contrast surface that is visible through the read window, the path of the transfer film being situated between the read window and the support.

3. A reading device according to claim 1, wherein the guides impose a path on the transfer film such that a portion of the path of the transfer film between the roll and the drum, the transfer film comes into contact with a cylindrical portion of the roll.

4. A reading device according to claim 3, wherein the read window is provided in a side wall of the cassette that is opposite to the side wall defining the print zone, and wherein the guides include at least two deflection cylinders between which the transfer film passes in the path between the roll and the drum.

5. A reading device according to claim 4, wherein the said at least two deflection cylinders are situated in the vicinity of a common diameter of the roll.

* * * * *